United States Patent [19]

Carene, Jr.

[11] Patent Number: 4,610,154

[45] **Date of Patent: * Sep. 9, 1986**

[54] TOOTH FORMING TOOL WITH TOOTHLESS CLAMPING SECTION FOR SPLINING TUBULAR ELEMENTS

[75] Inventor: Nicholas J. Carene, Jr., Hazel Park, Mich.

[73] Assignee: Ex-Cell-O Corporation, Troy, Mich.

[ * ] Notice: The portion of the term of this patent subsequent to Dec. 4, 2001 has been disclaimed.

[21] Appl. No.: 696,380

[22] Filed: Jan. 30, 1985

Related U.S. Application Data

[63] Continuation of Ser. No. 347,748, Feb. 10, 1982, abandoned.

[51] Int. Cl.[4] ..... B21D 17/04; B21H 5/00

[52] U.S. Cl. ..... 72/88

[58] Field of Search ..... 72/469, 88–90, 72/105, 102, 106, 311; 76/107 R; 29/159.2

[56] References Cited

U.S. PATENT DOCUMENTS

| | | | |
|---|---|---|---|
| 3,015,243 | 1/1962 | Drader | 72/469 |
| 3,672,203 | 6/1972 | Anderson | 72/469 |
| 3,818,736 | 6/1974 | Blue | 72/469 |
| 3,827,280 | 8/1974 | Miller et al. | 72/469 |
| 3,857,273 | 12/1974 | Miller et al. | 72/469 |
| 3,872,699 | 3/1975 | Blue | 72/469 |
| 3,874,219 | 4/1975 | Miller et al. | 72/469 |
| 3,902,349 | 9/1975 | Miller | 72/469 |
| 3,982,415 | 9/1976 | Killop | 72/88 |
| 4,028,921 | 6/1977 | Blue | 72/88 |
| 4,380,918 | 4/1983 | Killop | 72/469 |
| 4,383,428 | 5/1983 | Jungesjo | 72/88 |
| 4,399,678 | 8/1983 | Killop | 72/88 |

FOREIGN PATENT DOCUMENTS

| | | | |
|---|---|---|---|
| 942804 | 5/1956 | Fed. Rep. of Germany | 72/88 |
| 23891 | 10/1965 | Japan | 72/88 |

*Primary Examiner*—Daniel C. Crane

*Attorney, Agent, or Firm*—Edward J. Timmer

[57] ABSTRACT

A tool and machine are provided for pressure forming teeth in the periphery of a cylindrical, tubular workpiece such as a power transmission member by rolling. The tool has a working surface which improves the flow characteristics of the metal work piece during the tooth forming operation. Flow characteristics are particularly improved during initial contact of the tool with the workpiece by providing an initial toothless clamping section on the tool preceding the first toothed working section. The clamping section minimizes or eliminates radial workpiece separation from the mandrel ahead of the toothed section during the initial stage of the tooth-forming operation, which separation is manifested as a wave or buckling effect in the workpiece during initial forming and as an out-of-round condition in the final product.

1 Claim, 14 Drawing Figures

60
80
A
30
B
32
R
r
H
40
82
40a
41
40b
R'

H'
48
86
46
44a
44c
44
R'
44b
42
R

58
H''
56
88
54
52
50
R'
R'

TOOTH FORMING TOOL WITH TOOTHLESS CLAMPING SECTION FOR SPLINING TUBULAR ELEMENTS

This application is a continuation of application Ser. No. 347,748, filed Feb. 10, 1982, now abandoned.

FIELD OF THE INVENTION

This invention relates to tools and machines for pressure forming tooth elements, and more particularly, to an improved working surface for pressure generating teeth, splines, gear teeth forms and the like in the periphery of a tubular workpiece.

BACKGROUND OF THE INVENTION

The manufacture of power transmission members, to which this invention relates, utilizes a pair of racks and a mandrel to develop the tooth form in the periphery of an annular or tubular workpiece. The mandrel has the tooth form which is to be developed machined in an external peripheral working surface. A machine is provided for holding the mandrel and piece part and also includes tooth forming racks mounted on slides.

Tools for manufacturing tooth forms are shown in the patents to Pelphrey, U.S. Pat. No. 2,994,237, Miller, U.S. Pat. Nos. 3,827,280, 3,857,273, and 3,902,349, Anderson, U.S. Pat. No. 3,672,203 and Blue, U.S. Pat. No. 3,818,736. These patents show tooth forms having various characteristics for generating tooth forms in a cylindrical shaft member. The Miller U.S. Pat. No. 3,827,280 in particular discloses an initial section of sharp, file-like teeth adapted to grip and initiate rotation of a cylindrical workpiece followed by three sections of teeth adapted to generate a generally cycloidal tooth configuration which is then modified to the desired involute form by subsequent tooth sections. Another patent to Hildreth, U.S. Pat. No. 3,862,567 also shows a tool for manufacturing tooth forms which has selected teeth plated with copper, silver, gold or other suitable coating material to reduce tooth wear and fatigue. As can be seen in the aforementioned patents, the beginning or the leading portion of the tool has teeth which are deliberately altered in shape so that the rolling process will appropriately deform the metal in a gradual manner, thereby developing a final tooth shape which will be conjugate with the final tooth forms on the tool.

An early patent showing the rolling of a tooth form on a tubular element is U.S. Pat. No. 3,214,951 issued to McCardell. This shows a spline being rolled onto the outside of a tubular element. A later patent to Killop, U.S. Pat. No. 3,982,415 shows a splined mandrel and tool to specifically roll a power transmission member mounted directly on the mandrel. Here also, the teeth of the forming tool are shown having various shapes to gradually deform the metal so as to produce the desired tooth form both on the exterior of the power transmission member and on the interior thereof.

In using tools with tooth forms which have been shown in the prior art to spline tubular power transmission members, it was found that the wall thickness between the leading and trailing edge of a given tooth form on a power transmission member varies by as much as 50% and thus is extremely nonuniform in nature. Furthermore, a so-called wave or buckling effect in the workpiece generated ahead of the first toothed working section of the tool during the first 180° of rotation has bee observed by Applicant to cause uneven flow of workpiece material and a resultant out-of-round condition. Improvements in the flow of workpiece material during the tooth-forming process are highly desirable and needed.

An object of the invention is to incorporate an initial section on the tool adapted to cooperate with the mandrel to minimize the wave effect in the workpiece during the first 180° of rotation. Another object of the invention is therefore to reduce or eliminate the out-of-round condition caused by the wave effect.

Another object of the invention is to provide an improved tooth forming tool incorporating improved tooth generating means which improves the flow characteristics of the metal in the workpiece during the tooth generating process and develops a more uniform tooth element, especially improving uniformity in the wall thickness of the leading and trailing edges. Another object of the invention is to provide a tool for developing uniform tooth elements on both the external periphery and the internal periphery of the workpiece such as a power transmission member.

Another object of the invention is to provide an improved tool for pressure forming tooth elements in a cylindrical shell which enables the quantity production of tooth elements with improved quality. An object of the present invention is to provide an improved tooth forming tool of the indicated character incorporating improved means for generating teeth on tooth elements in a cylindrical tubular member whereby the strength and useful life of such tools is increased. A further object of the invention is to provide an improved tool for pressure forming tooth elements in a cylindrical tubular member which tool is economical and commercially feasible to manufacture, and is durable, efficient and reliable in operation.

SUMMARY OF THE INVENTION

This invention provides a tool and machine for pressure forming teeth in the periphery of a tubular workpiece. The tool is adapted to mesh with a rotatable toothed mandrel with the workpiece pressure formed therebetween. The tool includes a body having a leading end and a trailing end and is provided with a working surface having a plurality of teeth thereon wherein various sections of teeth disposed between the leading end and the trailing end have specific characteristics for pressure forming the tooth in a power transmission member during various stages of its pass through a machine adapted for such use. An important feature of the invention is the provision on the tool of an initial toothless clamping section which cooperates with the mandrel teeth to minimize or eliminate the wave or buckling effect in the workpiece during the first 180° of rotation. Preferably, the plane of the clamping section coincides approximately with the outer diameter of the workpiece when located on the mandrel. In a typical working embodiment, the clamping section is approximately two teeth in length. The leading and trailing edges of the teeth of the first toothed section following the flat clamping section are symmetrically configured to initially pressure form the workpiece near the center of the tooth space between adjacent mandrel teeth and thereby provide initial uniform workpiece deformation, preferably providing a uniform, corrugated type workpiece profile. A second toothed section of asymmetrical teeth is disposed between the first toothed section and the trailing end and the teeth thereof have a leading edge configuration conjugate to the leading edge configuration of the teeth to be formed on the workpiece and a trailing edge substantially similar in configuration as that provided in the teeth of the first section. The third toothed section of teeth disposed between the second toothed section and trailing end of the tool have the teeth configuration fully conjugate to the configuration of the teeth to be formed in the workpiece.

The above as well as other objects and advantages of the present invention will become apparent to those skilled in the art from the following descriptions of the appended claims and the accompanying drawings.

DESCRIPTION OF PREFERRED EMBODIMENTS

Figure 1:
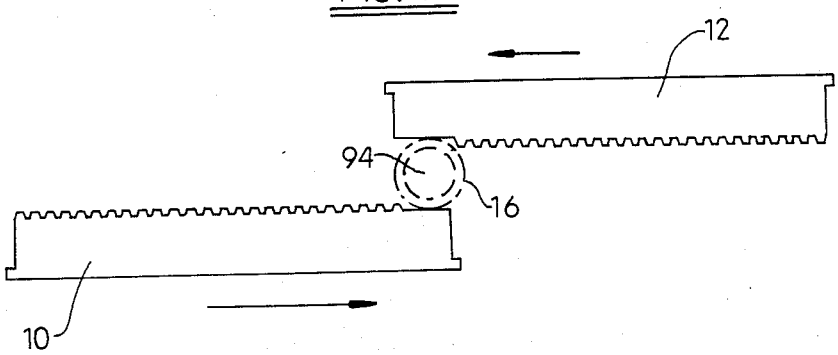
FIG. 1 is a side elevational view of a pair of rack type tools employing the present invention showing the same schematically with a mandrel and workpiece.

Referring to FIGS. 1-4, a preferred embodiment of the invention is illustrated. This embodiment comprises a specific tool construction for each of a pair of identical rack type tools 10 and 12 as shown in FIG. 1. These tools may be utilized with a splined mandrel 94 with the appropriate tooth form to pressure form spline, gear or other teeth on a cylindrical hollow workpiece. The workpiece 16 typically comprises a first large diameter tubular section 16*a*, a second smaller diameter tubular section 16*b* with a radial flange 16*c* joining the tubular sections. In the embodiment illustrated, teeth will be formed in tubular section 16*a*.

A machine in which a pair of rack type tools embodying the present invention may be utilized to pressure form a workpiece by deforming the cylindrical shell is described in detail in the aforementioned U.S. Pat. No. 3,214,951, the teachings of which are incorporated herein by reference, although it will be understood that tools embodying the present invention may be utilized in other types of known machines.

Figure 4:
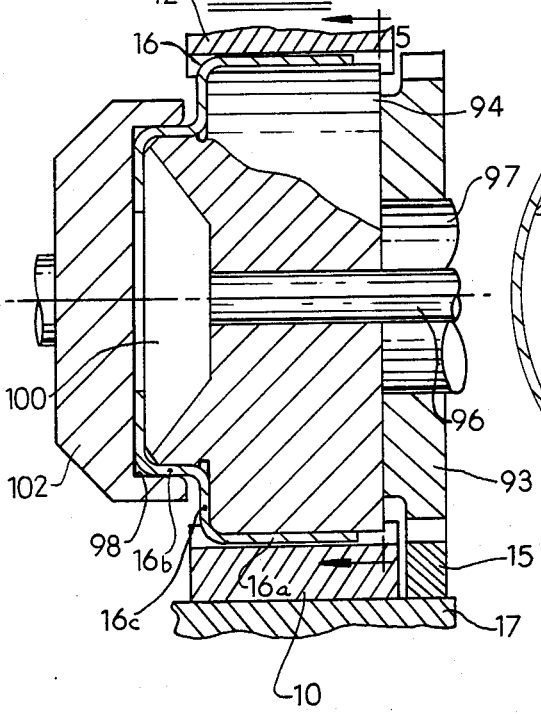
FIG. 4 is a sectional view showing the workpiece mounted on the stripper head and the confining member of the machine.
Figure 5:
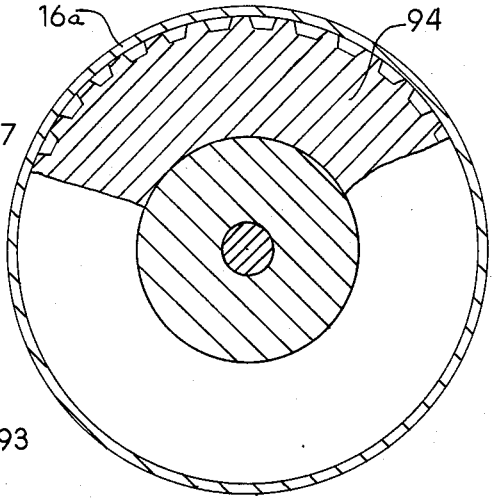
FIG. 5 is a sectional view along lines 5—5 in FIG. 4.

In general, as illustrated in FIG. 1, workpiece 16 is positioned between the lower and upper tools 10 and 12 embodying the present invention, the tools 10 and 12 being shown at the beginning of the operation which will pressure form the teeth on the periphery of tubular section 16*a* of the workpiece. The workpiece is preferably rotably supported about its longitudinal axis during splining by means such as shown in FIG. 4 known to those in the art. Here, the workpiece is shown supported on stripper head 100. A confining member 102 is also shown holding the workpiece 16, in particular tubular section 16*b*, onto the stripper head 100. The details of this holding means can be found in the aforementioned U.S. Pat. No. 3,214,951 and need not be discussed in detail here. The stripper head 100 which is connected to stripper rod assembly 96 is similar to that which is found in U.S. Pat. No. 4,178,790 issued to Buckley, et al which shows another method of manufacturing tooth elements in a cylindrical shell. The stripper head 100 is shown in detail in the aforementioned patent and will not be discussed here.

The lower and upper tools 10 and 12 are illustrated as identical rack type tools with teeth on their opposing working faces that engage the periphery of the tubular section 16*a* of the workpiece. The tools are movable lengthwise by suitable known means and are illustrated as being slideable in the direction of the arrows shown in FIG. 1. Means are provided to simultaneously move the tools 10 and 12 in opposite directions and such means are well known and shown in the aforementioned machine patents. Means in the form of a timing gear 93 carried on shaft 97 and a timing rack 15 carried on slide 17 with the tool 10 are provided to time or synchronize movement of the tools 10 and 12 and mandrel 94 to insure proper meshing of teeth.

Figure 2:
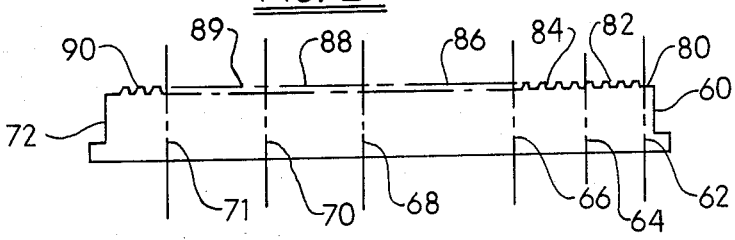
FIG. 2 is a side elevational view of the entire bottom rack type tool illustrated in FIG. 1.
Figures 3A, 3B, 3C:
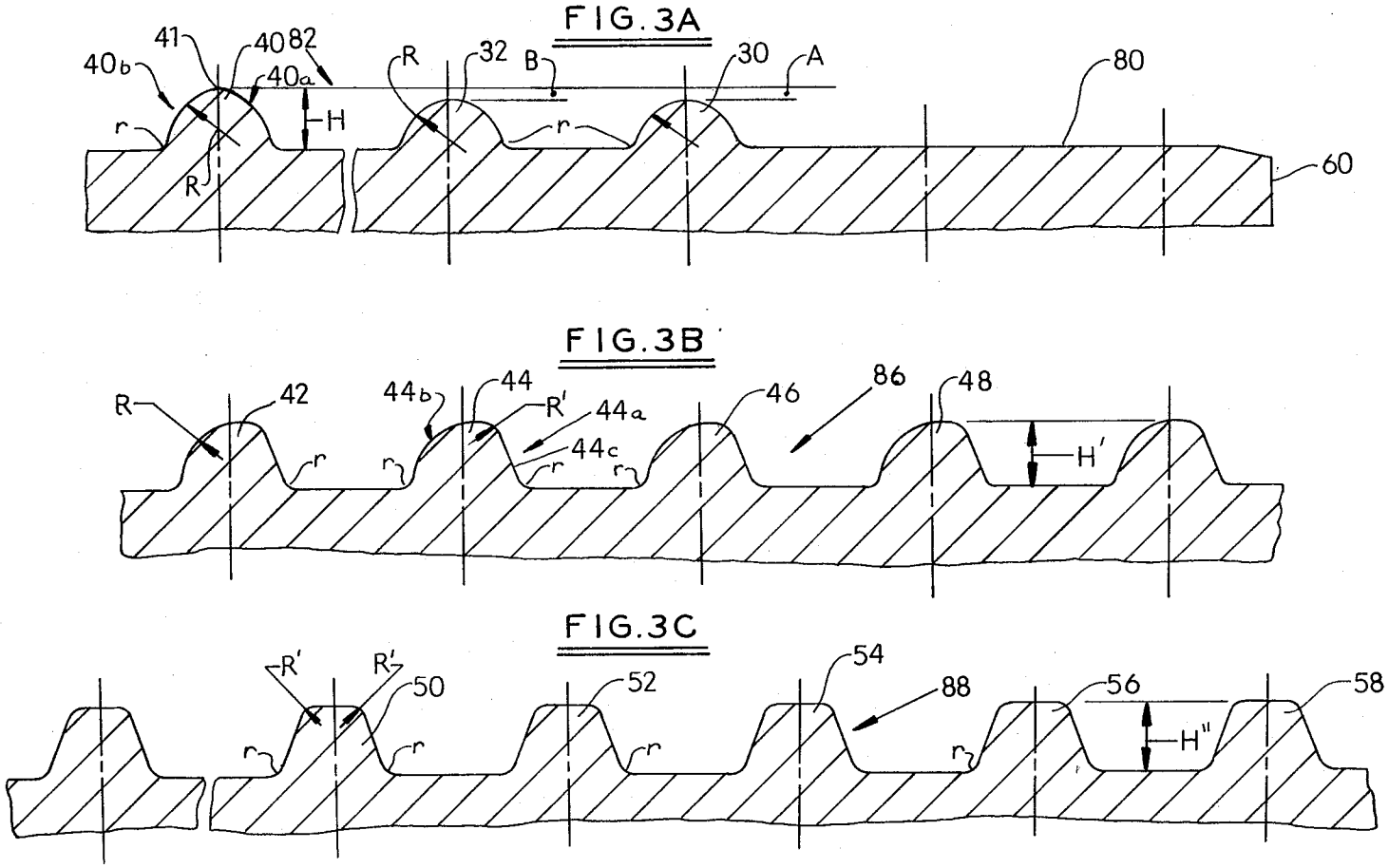
FIG. 3A is a partial section of the tool shown in FIG. 2.
FIG. 3B is a partial section of the tool shown in FIG. 2.
FIG. 3C is a partial section of the tool shown in FIG. 2.

FIG. 2 in conjunction with FIGS. 3A, 3B and 3C shows the various sections of each tool and the relationship of the teeth shown in FIG. 3 to their position along the length of the tool. The first, second, third and fourth toothed forming sections 82-90 of each tool are described and claimed in copending application entitled "Tooth Forming Tool For Tubular Elements" filed in the names of Paul Fitzpatrick and Roy Ridley and of common assignee herewith, incorporated herein by reference.

Figure 12:
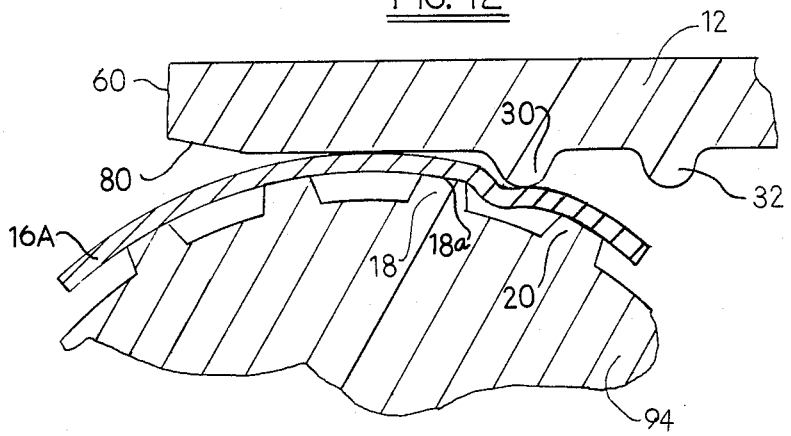
FIG. 12 is a partial sectional view of the flat, toothless clamping section of the tool and mandrel showing the workpiece therebetween.

The tool is shown in FIGS. 2 and 3 as having a leading end 60 with an initial clamping section 80 which is approximately two teeth in length and is preferably flat and devoid of any tooth form but whose plane conforms approximately to the outer diameter of tubular section 16*a* when the workpiece is on the mandrel. The need for this flat, toothless section 80 ahead of the first toothed section 82 of the tool was discovered from observations under high speed camera conditions of initial contact of the tooth form shown in FIG. 3A with the workpiece. It was discovered that the thin cylindrical sleeve 16*a*, of the workpiece pulls away radially from the mandrel tooth lands upon contact of the first rack tooth and produces a radial wave or buckling effect in the workpiece ahead of the first rack tooth. This wave or buckling effect is perpetuated during the first 180° of workpiece rotation when a pair of opposed racks are used as in FIG. 1 and is followed or chased by the first rack tooth during this period of workpiece rotation. The wave effect is highly disadvantageous since it causes uneven flow of the workpiece sleeve and leads to excessive material build-up, causing a two point out-of-round condition on the workpiece which condition then persists through the entire splining operation unless otherwise corrected by subsequent sections of the working surface. The clamping section 80 was provided to minimize or eliminate the wave effect from the outset by holding or clamping the sleeve 16*a* toward, preferably in contact against the top lands or tips of the mandrel teeth as the first tooth of the tool made contact, e.g. by clamping the sleeve 16*a* against land 18*a* of mandrel tooth 18 as shown in FIG. 12. This holding or clamping action was observed to substantially prevent the wave effect which had been seen on the high speed photographs during initial contact of the prior art racks with the workpiece and to improve the roundness of the final splined part. The clamping section 80 in the illustrated embodiment was provided by removing, such as by grinding off, the first two teeth in the toothed section 82 to the root plane.

The toothed section 82 of FIG. 2 which begins at line 62 and extends to line 64 consists of six teeth which have a symmetrical tooth form (relative to the vertical centerline) shown in FIG. 3A. The tooth profile form of tooth 40 is a gothic or a equilateral pointed arch shape provided in part by leading and trailing edges 40*a* and 40*b*. The half pointed arch form between tip 41 and root r of both the leading and trailing edges 40*a* and 40*b* of the tooth is shown at height H which is approximately 85%, typically between 80% and 90%, of the full conjugate tooth height which is to be developed in the workpiece. The radius R shown in FIG. 3A is approximately 130 thousandths or 0.130 inches on both the leading and trailing edges of these first six teeth. As can be seen on teeth 40, 32 and 30, the height of the teeth decreases from tooth 40 to tooth 30 with tooth 30 having lowest height at dimension A below tooth 32 and tooth 40 having the full height H. Dimension A and B differ by approximately 0.002 inch. That is, dimension A itself is 12 thousandths, dimension B is 10 thousandths continuing on back along the other teeth in this section until the tooth preceding tooth 40 will have a 2 thousandths difference in height therewith. The purpose of this lead-in section is to gradually start to deform the thin shell of tubular workpiece section 16*a* in a uniform manner substantially centrally in the tooth space between adjacent mandrel teeth as will be described in more detail later. As noted, the teeth of this section of the tool preferably will have the gothic or equilateral pointed arch form terminating in a reasonably sharp peak at 41 for example. However, other radii or a slightly flattened surface could also be employed at the very peak of the tooth form. However, best results were obtained with the pointed arch having the indicated radii. The next section 84 of teeth shown in FIG. 2 comprises approximately 18 teeth and all have the height H and equilateral pointed arch form of tooth 40 shown in FIG. 3A. These teeth extend from line 64 to line 66 and together with the symmetrical teeth previously described between lines 62 and 64 constitute a first section of symmetrical teeth.

The second section 86 of the tool has teeth extending from line 66 to line 68. The 18 teeth in this section of the tool have the asymmetrical configuration shown in FIG. 3B. Here, the height of the tooth form H′ will be approximately 96% of the full conjugate tooth height. The teeth can be seen to have a large radius R on the trailing edge 44*b* of the tooth form which is substantially the same radius as that in the previous section, that is, a 0.130 inch radius like tooth 40 shown in FIG. 3A. The leading edge 44*a* of the tooth, however, as noted for tooth 44, will have a small radius portion R′ which will be only approximately 55 thousandths and conjugate to the leading edge of the tooth to be formed and will be discussed in more detail later. Preferably, the leading flank portion 44*c* of the teeth in the second section will also be conjugate to the leading flank of the tooth to be formed. The radius r at the root of the tooth will be consistent throughout the tool. Also shown here are additional tooth forms 46 and 48 having an identical configuration as that of tooth 40. The teeth of section 86, as noted earlier, total approximately 18 in number and extend from line 66 to line 68.

The third section 88 of the tool contains teeth shown in FIG. 3C. The teeth of section 88 will all have the symmetrical shape of the teeth 50 through 58 which is the full conjugate tooth form having radii R′, i.e., about 55 thousandths, at both the leading and the trailing edge of the tooth form and having a radius of r at the root of the tooth form. The height of the tooth form H″ here will be considered 100% in viewing the relationship of these teeth to the other teeth on the tool. The teeth 50–58 will extend between line 68 and line 70 with approximately 24 teeth having this full configuration. A fourth section 89 of teeth is preferably provided from line 70 to line 71 and includes about twenty-four teeth having the symmetrical conjugate tooth form of teeth 50–58 (FIG. 3C), except that the tooth flanks and root in section 89 are relieved compared to those of teeth 50–58 by, for example, 0.003 inch. That is, the tooth height in section 89 is 3 thousandths greater than tooth height H″ in section 88 and the tooth addendum is likewise greater by 3 thousandths. The tooth height in section 89 would be considered 102%. The leading and trailing edge radii of the teeth in section 89 are the same as those of teeth 50–58, namely, about 55 thousandths. The purpose of the teeth in section 89 is to iron or set the metal shell at the minor (inner) diameter after splining by the previous toothed sections.

A final section 90 of the tool which will extend from line 71 to the trailing end 72 of the tool will have approximately 6 teeth in number. These teeth will have the same configuration as shown in FIG. 3C except beginning at the sixth tooth from the end 72, a top taper (0.002 inch relief) will occur so that the last tooth in section 90 will be 10 thousandths lower than height H″. In other words, the last tooth will have a height approximately 93% of the full height of the teeth 50–58.

The linear pitch for all of the teeth of tools 10 and 12 will be the same and will be selected to produce the desired tooth form on the external section of the workpiece section 16*a*. The tooth form and circular pitch provided on the mandrel 94 depends on the inner section or inner tooth form desired and is correlated with the tooth form provided on the tools 10 and 12 as is well known in the art.

OPERATION OF THE PREFERRED EMBODIMENT

Figure 6:
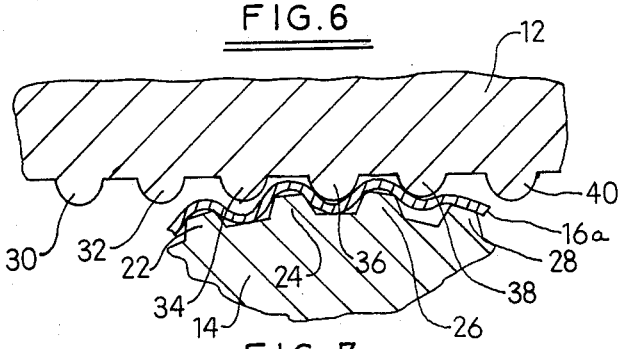
FIG. 6 is a partial section of the first toothed section of the tool and mandrel showing the workpiece therebetween.
Figure 7:
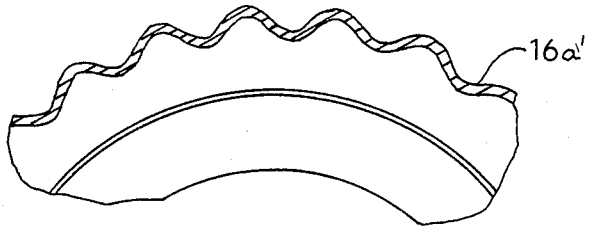
FIG. 7 is a partial section of the workpiece having a uniform corrugated or cycloidal profile after passing through the first toothed section of the tool.
Figure 8:
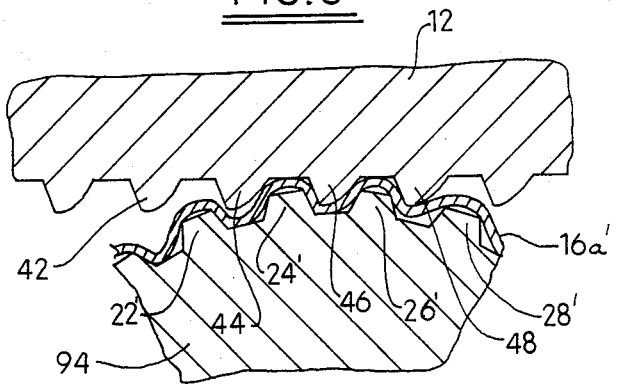
FIG. 8 is a partial section of the second toothed section of the tool and mandrel showing the workpiece therebetween.
Figure 9:
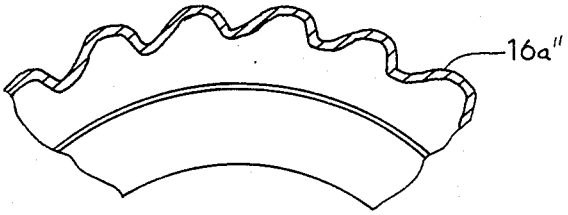
FIG. 9 is a partial section of the workpiece showing the teeth formed after a pass through the section of the tool shown in FIG. 8.
Figure 10:
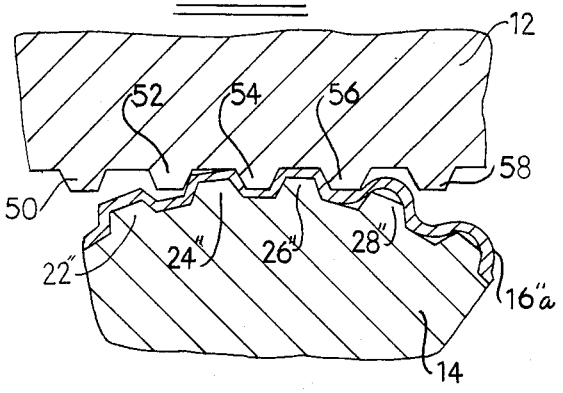
FIG. 10 is a partial section view of the third toothed section of the tool and mandrel showing the workpiece therebetween.
Figure 11:
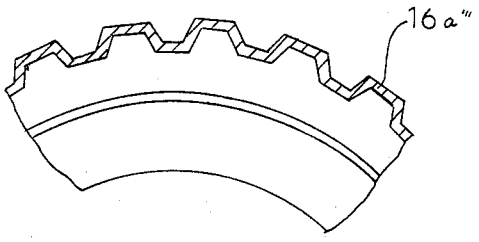
FIG. 11 is a partial sectional view of the piece part after completion of the rolling operation.

With the prior art tooth forms similar to that shown in FIG. 3C, the small leading edge radius R′ would be the first edge to strike the periphery of the workpiece 16. The leading edge would strike the workpiece off-center relative to the adjacent mandrel tooth space and would cause a pinching or trapping effect, drawing the metal unevenly into the mandrel tooth form and, upon completion of the rolling operation, providing a non-uniform tooth form. In particular, the leading edge of the final tooth form would be thicker than the trailing edge of that tooth form. At the same time, the wave or buckling effect takes place ahead of the leading edge making workpiece contact and contributes to the previously observed two point out-of-round condition. In order to compensate for the off-center initial pressure contact and the wave effect and uneven deforming or flowing of the metal that occurred, the clamping section 80 and the gothic arch tooth form shown in FIG. 3A were used in combination. The movement of the tool into the workpiece as shown in FIG. 6 would then cause the material to be deformed in a uniform manner on both the leading and the trailing edge substantially centrally in the tooth space 25 between the adjacent mandrel teeth 24 and 26 for example. As seen in FIGS. 6 and 12, the teeth 30–36 on the tool 12 have deformed the workpiece portion 16*a* in a uniform manner substantially centrally between the mandrel teeth, e.g. spandrel teeth 24 and 26 relative to forming tooth 36. Also, clamping section 80 has minimized the wave effect ahead of forming tooth 30. Since the height of the tooth is only 85% of the full conjugate height, the stretching or flowing of the peripheral surface of the shell will be uniform and will not cause a stretching of the trailing edge of the tooth form and a thickening of the leading edge of that tooth form. As can be seen in FIG. 7, workpiece 16*a*′ exhibits a uniform corrugated or cycloidal type cross-sectional profile and a uniform precursary tooth form. FIG. 8 shows the tool 12 and the mandrel 94 with the workpiece 16*a*′ therebetween. The teeth 42 through 48 have the asymmetrical configuration of the tooth form shown in FIG. 3B. The mandrel 94 has the conjugate full depth tooth form shown with teeth 22′, 24′, 26′ and 28′. The leading edge of tooth 46 of the tool can be seen to have the full conjugate small radius leading edge tooth form and causes the workpiece to flow at selected locations on the corrugated profile corresponding to leading edge locations into the leading edge of the tooth form on the mandrel. This effect causes the uniformity of the wall section or tooth section that is desired. The height of the tooth, as shown in FIG. 3B, is H′ which is approximately 96% of the full conjugate tooth height. This flowing of the workpiece into the shape shown in FIG. 9 of workpiece 16*a*″ will set that leading edge portion of the tooth form so that no additional stretching or flowing will occur at that portion in the next stage of the operation. Working of the remaining portion of the workpiece profile is shown in FIG. 10 as can be seen by the teeth 50 through 58 engaging the mandrel teeth 22′ through 28″ with the workpiece 16″ therebetween. Here, it can be seen that the tooth form of the teeth 50 through 58 are the full depth for those shown as teeth 88 in FIG. 2. This full conjugate tooth form, better seen in FIG. 3C, will develop what will now be the trailing edge and top land or tip of the tooth on the remaining workpiece profile, and as can be seen, the tooth form of the workpiece 16*a*″ laying on tooth 28 is coming into contact with tooth 56 on the tool 12. Since the leading edge of the tooth has been formed in the previous section 86 of the tool, the leading edge of that tooth form will have the same shape and will cause little or no movement of the workpiece in that portion of the cycle. The trailing edge of the tooth form will cause the workpiece material now to flow and develop the full conjugate shape 16*a*‴ including trailing edge and top land or tip which is shown in FIG. 11. The fourth section 89 of teeth will iron or set the minor workpiece diameter.

At the completion of the rolling operation, the stripper rod assembly 96 and stripper head 100 shown in FIG. 4 are used to remove the formed workpiece 16. As mentioned earlier, this method of stripping the part is shown in U.S. Pat. No. 4,178,790. Also shown in FIG. 4 is a confining member 102 which secures the workpiece to the stripper head by way of a pilot diameter 98 and holds the workpiece in position for its pass through the machine. This method of holding the workpiece is shown in U.S. Pat. No. 3,214,951.

In summary, what has been described is a tool for use in the forming of a power transmission member having a spline or gear tooth form. Also described is a tool for pressure forming teeth in the periphery of a tubular workpiece and adapted to mesh and cooperate with a rotatable toothed mandrel with the workpiece pressure formed therebetween. The tool includes a body having a leading end and a trailing end and is provided with a working face having an initial toothless section followed by a plurality of toothed sections of various tooth forms. The initial toothless section is flat and preferably located in the plane for clamping the workpiece sleeve toward the lands of the mandrel teeth to minimize or eliminate the observed wave or buckling effect in the workpiece during the first 180° of rotation after contact with the toothed sections. A first toothed section of the tool is disposed between said leading end and the trailing end, each of the teeth in the first section being symmetrical and having leading and trailing edges configured to uniformly deform the workpiece. A second section of teeth is disposed between the first section and the trailing end of the tool. Each of the teeth in this second section is asymmetrical, having the leading edge configuration conjugate to the leading edge configuration of the teeth to be formed that the workpiece located therebetween will develop the leading edge of the partial tooth form and a trailing edge configuration similar to the trailing edge configuration of the first described toothed section. A third section of the teeth on the tool are disposed between the second section and trailing end. Each of the teeth in this third section have the teeth configuration conjugate to the configuration of the teeth to be formed on the workpiece. A fourth section of teeth is preferably provided having the conjugate tooth form except that the tooth flanks and root are relieved so as to iron or set the minor workpiece diameter after passing through the third section. The final section of the tool will have the teeth gradually decreasing in height to release the workpiece as it completes the operation on the tools. Although the tooth form shown in the preferred embodiment is a transverse tooth form, it is conceivable that helical type tooth forms could be produced on such an arrangement using the same principles that are disclosed herein. It will be understood that if the tools are to generate helical teeth on the workpiece, the tool teeth will be inclined to the sides of the tool or directions of tool movement.

While preferred embodiments of the invention have been illustrated and described, it will be understood that various changes and modifications may be made without departing from the spirit and scope of the invention.

I claim:

1. In combination with a rotatably supported mandrel having radially extending teeth spaced apart from one another by tooth spaces and terminating in lands, a tool for pressure forming teeth in the periphery of a tubular workpiece carried on the mandrel and adapted to mesh with said rotatable toothed mandrel with the workpiece therebetween, said tool including a body having a leading and trailing end and being provided with a working face therebetween, said working face having an initial toothless clamping section between the leading end and trailing end and a toothed forming section between the clamping section and trailing end including a forming tooth configured to provide an equilateral pointed arch tooth form having radius-defined leading and trailing edges intersecting at the tooth form tip in a substantially sharp peak, said tooth form substantially uniformly deforming the workpiece in the mandrel tooth space, said clamping section being on a plane substantially coincident with the outer diameter of the workpiece when located on the mandrel and of sufficient length to overlie the land of the mandrel tooth adjacent and ahead of the tooth space in which the first forming tooth is intermeshing during initial contact of the toothed section with the workpiece to substantially prevent radial separation of the workpiece from said land of the mandrel tooth ahead of said toothed section.

* * * * *